US009933738B2

(12) United States Patent
Ikeda

(10) Patent No.: US 9,933,738 B2
(45) Date of Patent: Apr. 3, 2018

(54) IMAGE FORMING DEVICE, IMAGE FORMATION MANAGING DEVICE, AND IMAGE FORMING METHOD WITH MARGIN SETTING BETWEEN PAGES OF A PRINT JOB

(71) Applicant: Konica Minolta, Inc., Chiyoda-ku, Tokyo (JP)

(72) Inventor: Takemasa Ikeda, Hachioji (JP)

(73) Assignee: Konica Minolta, Inc., Tokyo (JP)

( * ) Notice: Subject to any disclaimer, the term of this patent is extended or adjusted under 35 U.S.C. 154(b) by 9 days.

(21) Appl. No.: 15/221,239

(22) Filed: Jul. 27, 2016

(65) Prior Publication Data

US 2017/0052493 A1 Feb. 23, 2017

(30) Foreign Application Priority Data

Aug. 18, 2015 (JP) ..... 2015-161029

(51) Int. Cl.
*G03G 15/00* (2006.01)

(52) U.S. Cl.
CPC ..... *G03G 15/5016* (2013.01); *G03G 15/6517* (2013.01)

(58) Field of Classification Search
CPC ..... G03G 15/5016; G03G 15/6517; G03G 15/652
See application file for complete search history.

(56) References Cited

U.S. PATENT DOCUMENTS 7,515,162 B2 * 4/2009 Horii ..... B41J 29/393 347/116
7,773,896 B2 * 8/2010 Yagawara ..... G03G 15/5058 399/46
8,447,201 B2 * 5/2013 Aoki ..... G03G 15/161 358/1.9
8,724,142 B2 * 5/2014 Sato ..... G06F 3/1203 358/1.15
8,770,698 B2 * 7/2014 Ochiai ..... B41J 3/60 347/104

(Continued)

FOREIGN PATENT DOCUMENTS

JP 2001-347488 A 12/2001
JP 2005-178074 A 7/2005

(Continued)

OTHER PUBLICATIONS

Machine translation of JP2001347488.*

(Continued)

*Primary Examiner* — David Bolduc
(74) *Attorney, Agent, or Firm* — Squire Patton Boggs (US) LLP

(57) ABSTRACT

The present invention includes an image forming unit that prints an image on a continuous transfer medium in accordance with a job; an operation displaying unit that receives setting of printing conditions; and a controlling unit that manages the job and controls printing in the image forming unit, the controlling unit having a function of setting a margin lying in a sub-scanning direction of the medium in the middle of printing the job in accordance with the printing conditions of the job and a function of performing image formation adjustment within the margin.

19 Claims, 9 Drawing Sheets

(56) References Cited

U.S. PATENT DOCUMENTS

2006/0029405 A1* 2/2006 Tanaka ..... G03G 15/553 399/27
2006/0062617 A1* 3/2006 Yamasaki ..... G03G 15/5062 399/384
2006/0188307 A1* 8/2006 Inui ..... G03G 15/652 399/396
2007/0036575 A1* 2/2007 Hamano ..... G03G 15/50 399/82
2008/0034996 A1* 2/2008 Yamamoto ..... G03G 15/652 101/225
2008/0317486 A1* 12/2008 Monma ..... G03G 15/0131 399/45
2009/0016785 A1* 1/2009 Haan ..... G03G 15/0131 399/301
2009/0110420 A1* 4/2009 Sheflin ..... G03G 15/5041 399/49
2010/0329756 A1* 12/2010 Mizes ..... G03G 15/0131 399/364
2011/0211009 A1* 9/2011 Fujinaga ..... B41J 29/393 347/16
2011/0211857 A1* 9/2011 Mikami ..... G03G 15/5029 399/82
2012/0014703 A1* 1/2012 Karasawa ..... G03G 15/238 399/49
2012/0020689 A1* 1/2012 Inoue ..... G03G 15/238 399/68
2012/0027442 A1* 2/2012 Torimaru ..... G03G 15/161 399/44
2012/0051823 A1* 3/2012 Hoshino ..... B41J 11/70 400/582
2012/0070160 A1* 3/2012 Aoki ..... G03G 15/5029 399/16
2012/0081715 A1* 4/2012 Takano ..... G06K 15/16 358/1.5
2014/0064747 A1* 3/2014 Numazu ..... G03G 15/5062 399/19
2014/0125982 A1* 5/2014 Takemura ..... G03G 15/5062 356/421
2015/0071671 A1* 3/2015 Kiuchi ..... G03G 15/5062 399/72
2015/0160599 A1* 6/2015 Kamihara ..... G03G 15/1605 399/27
2015/0168902 A1* 6/2015 Sasami ..... G03G 15/5054 399/72
2016/0078331 A1* 3/2016 Ikeda ..... B41J 15/00 358/1.14
2016/0085195 A1* 3/2016 Uchida ..... G03G 15/5095 399/45
2016/0109840 A1* 4/2016 Oonishi ..... G03G 15/652 399/45
2016/0124343 A1* 5/2016 Sakurai ..... G03G 15/105 399/58
2016/0170358 A1* 6/2016 Fukai ..... G03G 15/556 399/27
2016/0291517 A1* 10/2016 Kamei ..... G03G 15/556

FOREIGN PATENT DOCUMENTS

JP 2006-084796 3/2006
JP 2006-293141 A 10/2006
JP 2007-50545 A 3/2007
JP 2014-134673 A 7/2014
JP 2015-055846 3/2015
JP 2015-118108 A 6/2015

OTHER PUBLICATIONS

Machine translation of JP2006293141.*
Machine translation of JP2014134673.*
Machine translation of JP2015118108.*
Notification of Reasons for Refusal dated Jun. 28, 2017 for JP Application No. 2015-161029 with English translation, 8 pages.
Decision of Rejection dated Sep. 26, 2017, in Japanese Patent Application No. 2015-161029, 8 pages.

* cited by examiner

IMAGE FORMING DEVICE, IMAGE FORMATION MANAGING DEVICE, AND IMAGE FORMING METHOD WITH MARGIN SETTING BETWEEN PAGES OF A PRINT JOB

The present U.S. patent application claims a priority under the Paris Convention of Japanese patent application No. 2015-161029 filed on Aug. 18, 2015, the entirety of which is incorporated herein by references.

BACKGROUND OF THE INVENTION

Field of the Invention

The present invention relates to an image forming device, an image formation managing device, and an image forming method that allow printing on a continuous transfer medium.

Description of the Related Art

An image forming device sometimes performs image formation adjustment in the middle of a job exceeding a continuous printing distance. Examples of image formation adjustment include toner consumption adjustment. Toner consumption adjustment outputs a toner-emitting patch image, for example, on a middle transfer belt in order to change a degraded developer to a new one. For printing on sheet paper, toner consumption can be done by forming a toner consumption patch in a space between sheets. However, an image forming device treating roll paper and other continuous transfer mediums which do not have such a space is required to perform adjustment while conveying roll paper.

Japanese Patent Laid-Open No. 2015-55846, for example, provides an image forming device that forms an image on a continuous sheet of paper and performs image density control even during an image forming process. Specifically, the image forming device includes: image forming means that forms an image by transferring a toner image on an image holder to the continuous sheet of paper; and controlling means that controls the image forming unit such that, before the image is formed on the continuous sheet of paper, a density-adjusting toner image is formed on the image holder while the image holder and the continuous sheet of paper are apart from each other, that performs the first density control according to the density of the density-adjusting toner image, and that performs the second density control, which is different from the first density control, during image formation on the continuous sheet of paper while the image holder and the continuous sheet of paper are in contact with each other.

Japanese Patent Laid-Open No. 2006-84796 provides a space lying in the sub-scanning direction to place a patch.

However, when a job exceeding a continuous printing distance is performed in a printing operation on a continuous transfer medium, image formation adjustment is usually automatically performed after the distance, resulting in an unintended margin area, disruption of an image cycle with even spaces (1-mm space), and an unnecessary space between images due to paper conveying. Besides, although the user sometimes smoothly moves to the subsequent processing by inserting a blank at a break between jobs to separate the jobs, such an unintended margin may hinder such a smooth movement to the subsequence processing.

SUMMARY OF THE INVENTION

An object of the present invention, which has been made on the above background, is to provide an image forming device, an image formation managing device, and an image forming method that perform margin setting and thus allow image formation adjustment in a margin area when printing on a continuous transfer medium.

Thus, to achieve at least one aspect of the abovementioned objects, according to an aspect, an image forming device reflecting one aspect of the present invention includes:

an image forming unit that prints an image on a continuous transfer medium in accordance with a job;

an operation displaying unit that receives setting of printing conditions; and a controlling unit that manages the job and controls printing in the image forming unit, the controlling unit having a function of setting a margin lying in a sub-scanning direction of the medium in the middle of printing the job in accordance with the printing conditions of the job and a function of performing image formation adjustment within the margin.

In the image forming device according to the abovementioned aspect, it is preferable that the image formation adjustment is toner consumption adjustment.

In the image forming device according to the abovementioned aspect, it is preferable that the setting of printing conditions includes setting of margin position.

In the image forming device according to the abovementioned aspect, it is preferable that the controlling unit automatically sets the margin length to at least a length necessary for image formation adjustment, in accordance with the setting of margin position.

In the image forming device according to the abovementioned aspect, it is preferable that the controlling unit recommends at least a margin length necessary for image formation adjustment in accordance with the setting of margin position.

In the image forming device according to the abovementioned aspect, it is preferable that the controlling unit sets the margin length to an integral multiple of a distance between pages.

In the image forming device according to the abovementioned aspect, it is preferable that the controlling unit enables setting of the margin position and the margin length through the operation displaying unit.

In the image forming device according to the abovementioned aspect, it is preferable that the controlling unit determines a necessary length of the margin on the basis of image data to be printed and/or a location to insert the margin.

In the image forming device according to the abovementioned aspect, it is preferable that the controlling unit determines a necessary length of the margin on the basis of coverage of the image data.

In the image forming device according to the abovementioned aspect, it is preferable that the controlling unit determines, on the basis of the location in which the margin can be inserted, the margin length for the location.

In the image forming device according to the abovementioned aspect, it is preferable that the image formation adjustment uses a predetermined continuous printing distance as a reference, and, when the job exceeds the continuous printing distance, the controlling unit indicates a warning if a length of a blank is not set or if a set length of a blank is not enough, and does not indicate a warning if a blank with an enough length is set in a location before the continuous printing distance.

In the image forming device according to the abovementioned aspect, it is preferable that the controlling unit enables setting of a margin between jobs under a printing condition of continuous printing of combined jobs.

To achieve at least one aspect of the abovementioned objects, according to an aspect, an image formation managing device reflecting one aspect of the present invention manages an image forming device printing an image on a continuous transfer medium in accordance with a job and includes:

an operation displaying unit that receives setting of printing conditions; and a management controlling unit that manages the job and instructs the image forming device to perform printing, in which the management controlling unit also instructs the image forming device to set a margin lying in a sub-scanning direction of the medium in the middle of printing the job in accordance with the printing conditions of the job and to perform image formation adjustment within the margin.

To achieve at least one aspect of the abovementioned objects, according to an aspect, an image forming method reflecting one aspect of the present invention is a method for printing an image on a continuous transfer medium in accordance with a job, including the steps of:

receiving setting of printing conditions;

setting a margin lying in a sub-scanning direction of the medium in the middle of printing the job in accordance with the printing conditions of the job; and performing image formation adjustment within the margin.

In the image forming method according to the abovementioned aspect, it is preferable that the image formation adjustment is toner consumption adjustment.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DETAILED DESCRIPTION OF THE PREFERRED EMBODIMENT

Hereinafter, an embodiment of the present invention will be described with reference to the drawings. However, the scope of the invention is not limited to the illustrated examples.

An image forming device according to one embodiment of the present invention will now be described with reference to the attached drawings.

Figure 1:
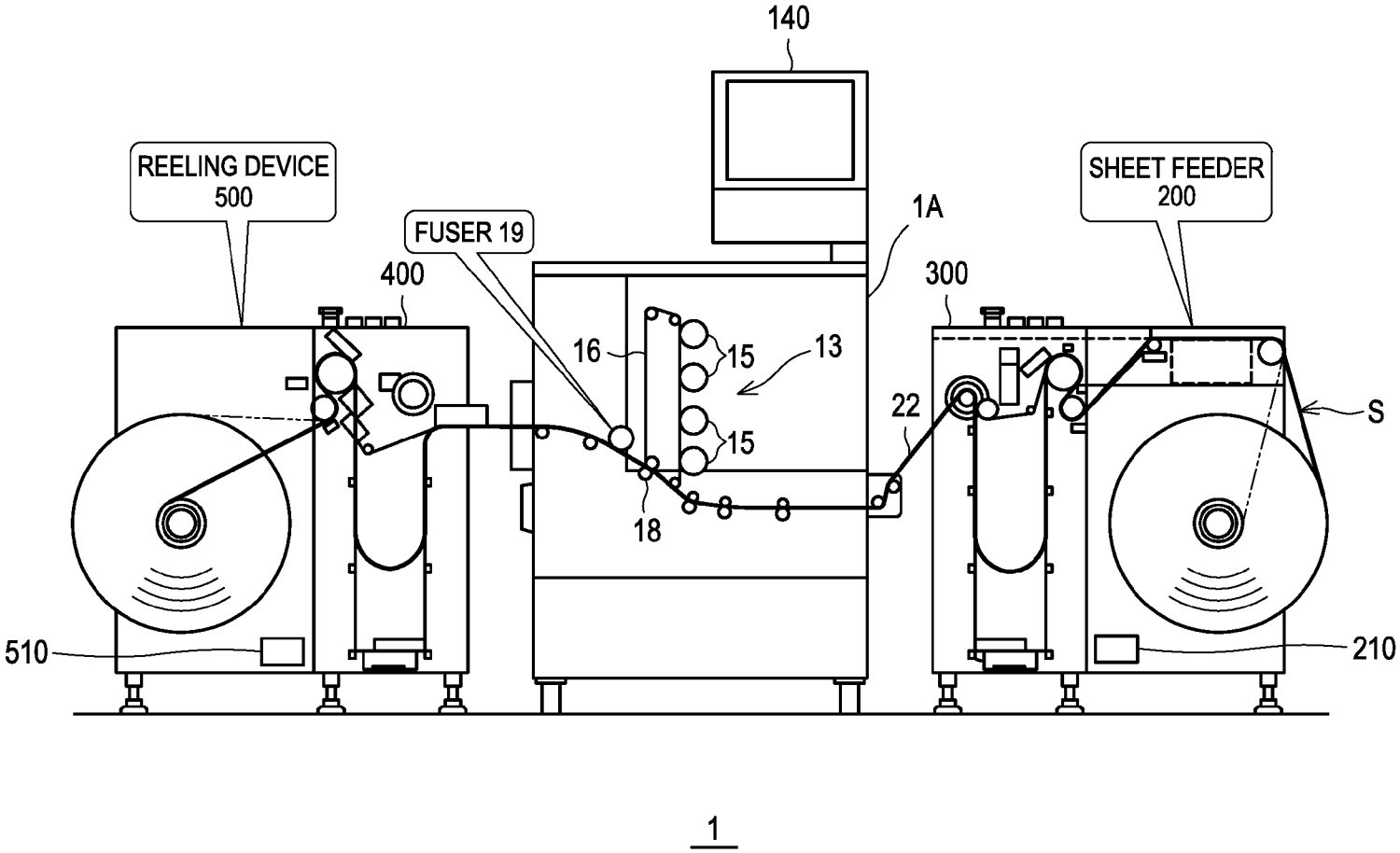
FIG. 1 is a schematic diagram of an image forming device according to one embodiment of the present invention.

FIG. 1 is a schematic diagram of the image forming device.

An image forming device 1 includes a device body 1A including an image forming unit 13, a sheet feeding adjuster 300 in the upstream of the device body 1A, and a sheet feeder 200 in the upstream of the sheet feeding adjuster 300. The image forming device 1 also includes a sheet ejecting adjuster 400 in the downstream (toward which sheets are ejected) of the device body 1A, and a reeling device 500 in the downstream of the sheet ejecting adjuster 400.

It should be noted that this embodiment describes the image forming device 1 consisting of the device body 1A and other devices connected to the device body 1A, although any type or number of devices can be connected to the device body 1A. Alternatively, the image forming device can only consist of the device body 1A. In this case, the device body 1A can constitute an image forming system together with other devices.

The sheet feeder 200 has a function of storing, holding, and feeding a continuous sheet of paper, which is roll paper S here.

The sheet feeding adjuster 300 has a buffer function for adjusting adjacencies and a small difference between the speeds of the sheet feeder 200 and the device body 1A. The sheet ejecting adjuster 400 has a buffer function for adjusting adjacencies and a small difference between the speeds of the device body 1A and the reeling device 500. It should be noted that a cutting unit to cut roll paper can be installed between the device body 1A and the reeling device 500 and perform off-line cutting.

The reeling device 500 has a function of reeling and holding the ejected roll paper.

It should be noted that this embodiment uses roll paper as a continuous sheet of paper although the continuous sheet of paper here should not be limited to roll paper and may be any other continuous sheet of paper, for example, continuous slip paper or continuous form paper. The continuous sheet of paper can be provided in the form of either roll paper or fanfold paper. The continuous sheet of paper corresponds to a continuous transfer medium of the present invention. The continuous transfer medium is not necessarily paper.

The image forming device 1 includes the image forming unit 13, which forms images on sheets of paper, in the device body 1A and an operation displaying unit 140, which receives operation by the operator and shows information, above the device body 1A. The operation displaying unit 140 can separately include an operating unit to operate and a display to present images. Alternatively, the operating unit and the display can be integrated into a single piece, such as a touch screen LCD.

The image forming device 1 includes a conveying path 22 passing the sheet feeder 200, the sheet feeding adjuster 300, and the image forming unit 13 in this order. The conveying path 22 then passes the image forming unit 13, the sheet ejecting adjuster 400, and the reeling device 500 in this order.

The roll paper S stored in the sheet feeder 200 is fed to the conveying path 22.

A conveyer unit in this embodiment consists of the conveying path 22, a conveyer roller, a motor (not shown) to rotate a roller, and other components.

The image forming unit 13 includes photoreceptors 15 for different colors (e.g., cyan, magenta, yellow, and black). Each photoreceptor is provided with a charger, a writing unit, and a developing unit (which are not shown) around it. The surface of each photoreceptor charged by the charger is subjected to exposure conducted by a writing unit, such as an LD, based on the image data of a document stored in an image memory, so that a latent image is formed on the surface of the photoreceptor 15. The latent image is developed by the developing unit and becomes a toner image. The toner image is transferred onto a middle transfer belt 16. The image on the middle transfer belt 16 is transferred onto the roll paper S, which is conveyed by the conveying path 22, through the secondary transfer roller 18. It should be noted that the present invention includes the above-explained color image forming device that includes a photoreceptor for each color and a middle transfer belt although the image forming device in the present invention can alternatively be a monochrome image forming device.

After the transfer in the image forming unit 13, the image is fused by heat and pressure applied by a fuser 19 and then ejected from the device body 1A as the roll paper is conveyed.

Figure 2:
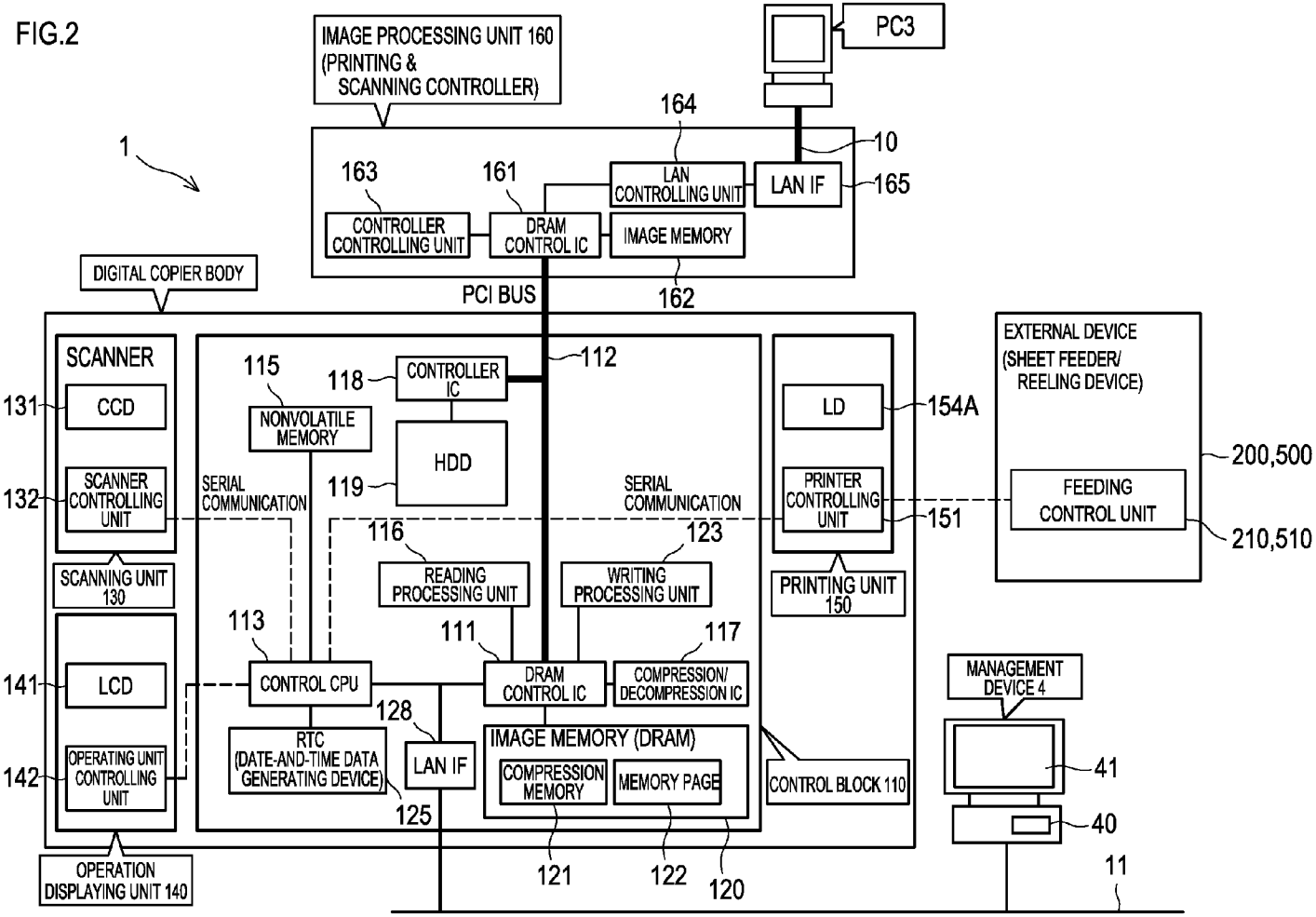
FIG. 2 is an electrical block diagram of an image forming system including the image forming device.

The functions of the image forming device 1 will now be described with reference to the block diagram of FIG. 2.

The image forming device 1 mainly includes a copier body including a control block 110, a scanning unit 130, an operation displaying unit 140, and a printing unit 150; and an image processing unit (printing & scanning controller) 160 that processes image data traveling between the image forming device 1 and an external device (PC3) via a Network 10.

The control block 110 includes a PCI bus 112 which is connected to a DRAM control IC 111 in the control block 110. An HDD 119 is connected to the PCI bus 112 via a controller IC 118. The HDD 119 can store image data, for example.

The control block 110 also includes a control CPU 113 which is connected to the DRAM control IC 111. A nonvolatile memory 115 is connected to the control CPU 113. The nonvolatile memory 115 stores programs to operate the control CPU 113, data of settings of the image forming device 1, process control parameters, a setting of continuous printing distance for toner consumption adjustment, and a margin length required for toner consumption adjustment. Different settings of the margin length based on different coverages of jobs can be stored.

The control CPU 113 generally controls the image forming device 1, checks the state of the whole image forming device, and controls conveying of the roll paper and image formation. In other words, the control CPU 113 functions as a controlling unit for the present invention.

An RTC (date-and-time data generating device) 125 is connected to the control CPU 113 and can send date-and-time data to the control CPU 113.

The scanning unit 130 includes a CCD 131 performing optical reading, and a scanner controlling unit 132 generally controlling the scanning unit 130. The scanner controlling unit 132 is connected to the control CPU 113 so that they can serially communicate with each other, and is controlled by the control CPU 113. It should be noted that the scanner controlling unit 132 can consist, for example, of a CPU and programs to operate it. Image data read with the CCD 131 is processed in the reading processing unit 116. The reading processing unit 116 is connected to the DRAM control IC 111.

The operation displaying unit 140 includes a touch screen LCD 141 and an operating unit controlling unit 142. The LCD 141 and the operating unit controlling unit 142 are connected to each other. The operating unit controlling unit 142 and the control CPU 113 are connected to each other so that they can serially communicate with each other. This configuration allows the operation displaying unit 140 to be controlled by the control CPU 113. It should be noted that the operating unit controlling unit 142 can consist, for example, of a CPU and programs to operate it.

The operation displaying unit 140 is used to setup the device body 1A and the sheet feeder 200. Image formation and feeding of roll paper through the sheet feeder 200 are controlled according to the setup.

The operation displaying unit 140 can receive inputs related to the setup of the image forming device 1 and operation commands, e.g. operation control conditions, can show the settings, the mechanical state, and various information, and is controlled by the control CPU 113. The operation displaying unit 140 enables predetermined operations, for example, settings of margin position and margin length to be executed by the control CPU 113.

The DRAM control IC 111 is connected to an image memory 120 consisting of a compression memory 121 and a memory page 122. The image memory 120 stores image data acquired with the scanning unit 130 and image data acquired via the Network. The image memory 120 is therefore a storage area for image data and stores image data for a job to be printed. The DRAM control IC 111 can also allow image data related to a plurality of jobs to be stored in the image memory 120. The image memory 120 can therefore also store image data for a reserved job. The image data can also be stored in the HDD 119.

The DRAM control IC 111 is connected to a compression/decompression IC 117 that compresses image data or decompresses the compressed data. The DRAM control IC 111 is connected to a writing processing unit 123. The writing processing unit 123 is connected to an LD 154A in the printing unit 150 and performs processing of data used for the operation of the LD 154A. The LD 154A includes LDs for different colors. The printing unit 150 controls the image forming unit 13 and the conveyer unit including the conveying path 22.

The printing unit 150 includes a printer controlling unit 151 that generally controls the printing unit 150. The printer controlling unit 151 is connected to and controlled by the control CPU 113, specifically starts/stops a printing operation according to the parameters given by the control CPU 113. The printer controlling unit 151 is controllably connected to a feeding control unit 210 controlling feeding of roll paper through the sheet feeder 200, and a feeding control unit 510 controlling reeling with the reeling device 500, so that the control CPU 113 can give instructions for controls of feeding of roll paper and reeling via the printer controlling unit 151.

The PCI bus 112 connected to the DRAM control IC 111 is connected to a DRAM control IC 161 in the image processing unit (printing & scanning controller) 160. In the image processing unit (printing & scanning controller) 160, the DRAM control IC 161 is connected to an image memory 162. In the image processing unit (printing & scanning controller) 160, the DRAM control IC 161 is connected to a controller controlling unit 163 and the DRAM control IC 161 is connected to a LAN controlling unit 164 and a LAN interface 165. The LAN interface 165 is connected to the Network 10.

The external device (PC3) and other devices are connected to the Network 10 so that they can send/receive image data to/from the image forming device 1.

The control CPU 113 is also connected to a LAN interface 128 which is connected to a Network 11. The Network 11 is connected to a management device 4. The management device 4 includes a management controlling unit and an operation displaying unit 41. The management controlling unit 40 is operated to generally control the management device 4. The management controlling unit 40 can also manage the image forming device 1. The management controlling unit 40 can consist of a CPU, programs to operate it, and a storage, for example. The management controlling unit 40 can instruct the image forming device 1 to perform image formation, settings of margin formation, and toner consumption adjustment. The management device 4 corresponds to an image formation managing device of the present invention.

It should be noted that the Networks 10 and 11 can be identical.

The basic operation of the image forming device 1 will now be explained.

First, the process of accumulating image data in the image forming device 1 will be explained.

To read an image of a document with the scanning unit 130 and generate image data, the scanning unit 130 optically reads the image of the document with the CCD 131. In this case, the scanner controlling unit 132, which receives commands from the control CPU 113, controls the operation of the CCD 131. The image read with the CCD 131 is processed in the reading processing unit 116. The processed image data is compressed in the compression/decompression IC 117 with a predetermined approach and then stored in the compression memory 121 or the HDD 119 through the DRAM control IC 111. The image data stored in the compression memory 121 or the HDD 119 can be controlled by the control CPU 113 as a job.

To acquire image data from an external device, e.g., image data sent from the external device (PC3) through the Network 10, the image data is stored in the image memory 162 by the DRAM control IC 161 controlled by the controller controlling unit 163 via the LAN interface 165 and the LAN controlling unit 164. The data in the image memory 162 is temporarily stored in the memory page 122 via the DRAM control IC 161, the PCI bus 112, and the DRAM control IC 111. The data stored in the memory page 122 is sequentially sent to the compression/decompression IC 117 via the DRAM control IC 111, compressed in compression/decompression IC 117, stored in the compression memory 121 or the HDD 119 via the DRAM control IC 111, and then controlled by the control CPU 113 in the above-described manner.

Alternatively, upon reading of the image data, a combined JOB unit can be created from the received data and the resulting data can be stored in the compression memory 121.

To output an image on the image forming device 1, i.e., to use the image forming device 1 as a copier or printer, the image data stored in the compression memory 121 or the HDD 119 is sent to the compression/decompression IC 117 via the DRAM control IC 111 and then expanded in the compression/decompression IC 117. The expanded image data is repeatedly expanded on the LD 154A by the writing processing unit 123, which allows the image data to be printed on the roll paper S.

When the image forming device 1 is used as a copier, information including the set printing conditions (printing mode) is notified on the operation displaying unit 140 and setting information is generated in the control CPU 113. The generated setting information can be stored in a RAM in the control CPU 113. The commands "Copy for check" and "Normal print" are also selected here.

When the image forming device 1 is used as a printer, the printing conditions are set by a printer driver in the external device (PC3). Like images, the printing conditions set here pass the external device (PC3), the LAN IF 165, the image memory 162, the DRAM control IC 161 (controller), and the DRAM control IC 111 (body), and are eventually stored in the memory page 122.

In the printing unit 150, each component is controlled by the printer controlling unit 151 receiving commands from the control CPU 113.

To output an image on the image forming device 1, the printing conditions are set through the operation displaying unit 140. This setting allows the control CPU 113 to control printing operations. The printing conditions can include the setting of a margin. In the image forming unit 13, a toner image on each photoreceptor 15 is transferred onto the middle transfer belt 16, then is transferred onto the roll paper S, which is fed through the sheet feeder 200, by the secondary transfer roller 18, and then is fused by the fuser 19. The sheet of paper with an image formed on it is conveyed to the sheet ejecting adjuster 400 via the conveying path 22 and then reeled and held on a roll by the act of the downstream reeling device 500. When there is a plurality of reserved jobs, the images are sequentially output in a predetermined order.

Figure 3:
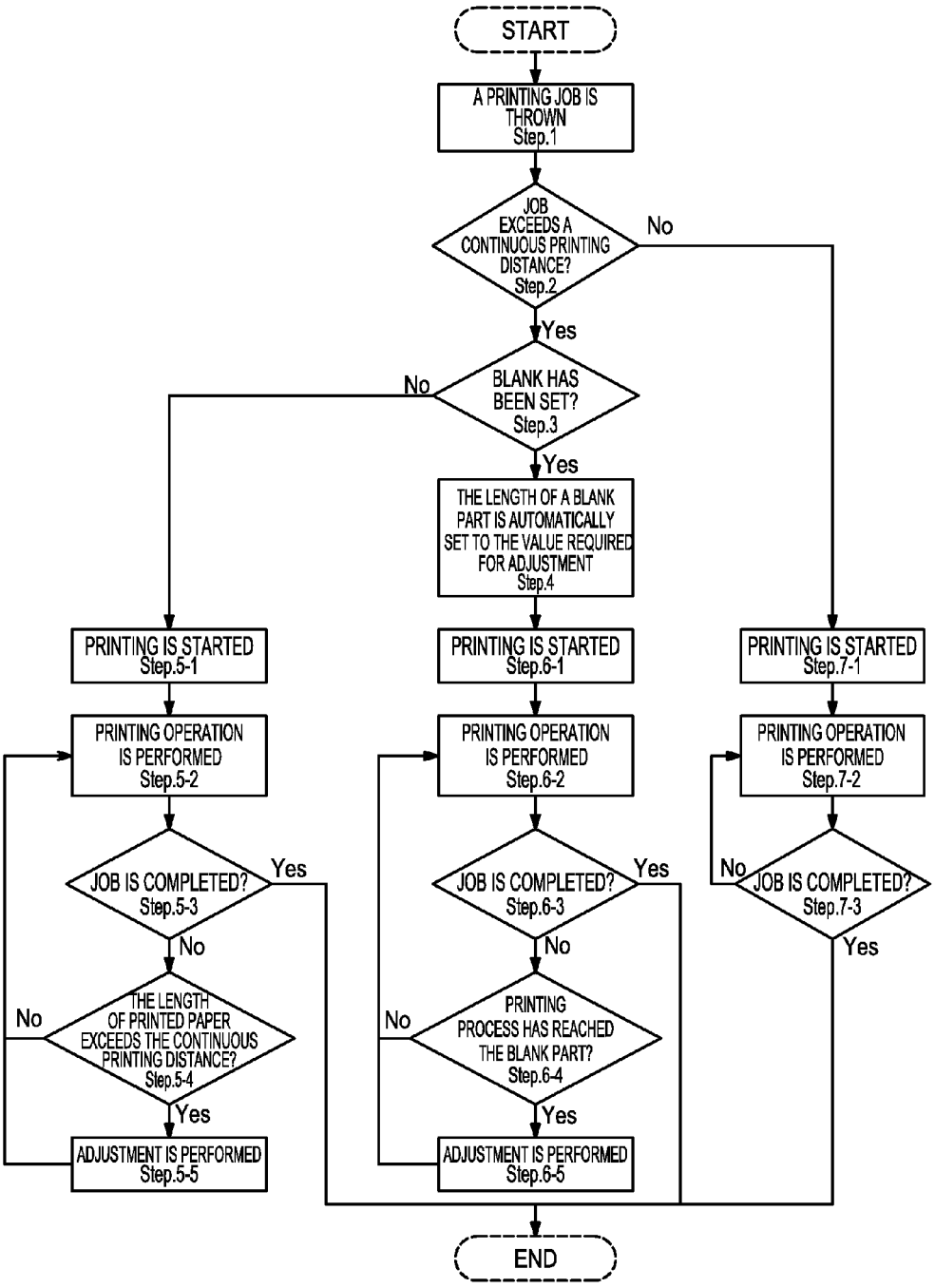
FIG. 3 is a flow chart of a process for printing a job that requires image formation adjustment.

The process of printing a job involving toner consumption adjustment will now be explained with reference to the flow chart of FIG. 3. It should be noted that the following process is executed under control by the controlling unit.

A printing job is first thrown (Step 1) and whether the job exceeds a continuous printing distance is determined (Step 2). The continuous printing distance, which is variable, is set to 300 m, for example. If the job does not exceed the continuous printing distance (Step 2, No), printing is started (Step 7-1), a printing operation is performed (Step 7-2), and whether the job is completed is determined (Step 7-3). If the job is not completed (Step 7-3, No), the process returns to Step 7-2 to execute a printing operation. Afterwards, if the job is completed (Step 7-3, Yes), the process terminates.

Meanwhile, if the job exceeds the continuous printing distance (Step 2, Yes), whether blank has been set is determined (Step 3). The blank setting can be performed by the operator (e.g., user) during setting of printing conditions.

If the blank setting has not been performed (Step 3, No), printing is started (Step 5-1), a printing operation is performed (Step 5-2), and whether the job is completed is determined (Step 5-3). If the job is completed (Step 5-3, Yes), the process terminates.

If the job is not completed (Step 5-3, No), whether the length of printed paper exceeds the continuous printing distance is determined (Step 5-4). If the length of printed paper does not exceed the continuous printing distance (5-4, No), the process returns to Step 5-2 to perform a printing operation. If the length of printed paper exceeds the continuous printing distance (5-4, Yes), printing is halted between images and toner consumption adjustment is performed (adjustment; Step 5-5). Subsequently, the process returns to Step 5-2 to perform a printing operation.

The adjustment in Step 5-5 results in an unintended margin. In this case, paper is conveyed even during the adjustment and a cycle of images to be printed (a space of 1 mm between images) collapses, resulting in an unintended space between images.

Meanwhile, if the blank setting has been performed (Step 3, Yes), the length of a blank part is automatically set to the value required for toner consumption adjustment (Step 4). Subsequently, printing is started (Step 6-1), a printing operation is performed (Step 6-2), and whether the job is completed is determined (Step 6-3). If the job is completed (Step 6-3, Yes), the process terminates.

If the job is not completed (Step 6-3, No), whether the printing process has reached the blank part predetermined in the setting is determined (Step 6-4). If the printing process does not reach the blank part (Step 6-3, No), the process returns the Step 6-2 to perform a printing operation.

If the printing process reaches the predetermined blank part (Step 6-4, Yes), toner consumption adjustment is performed within a margin area (adjustment; Step 6-5), and the process then returns to Step 6-2 to perform a printing operation. The adjustment is performed within a margin predetermined by the operator, so that an unintended margin is not left.

Figure 4:
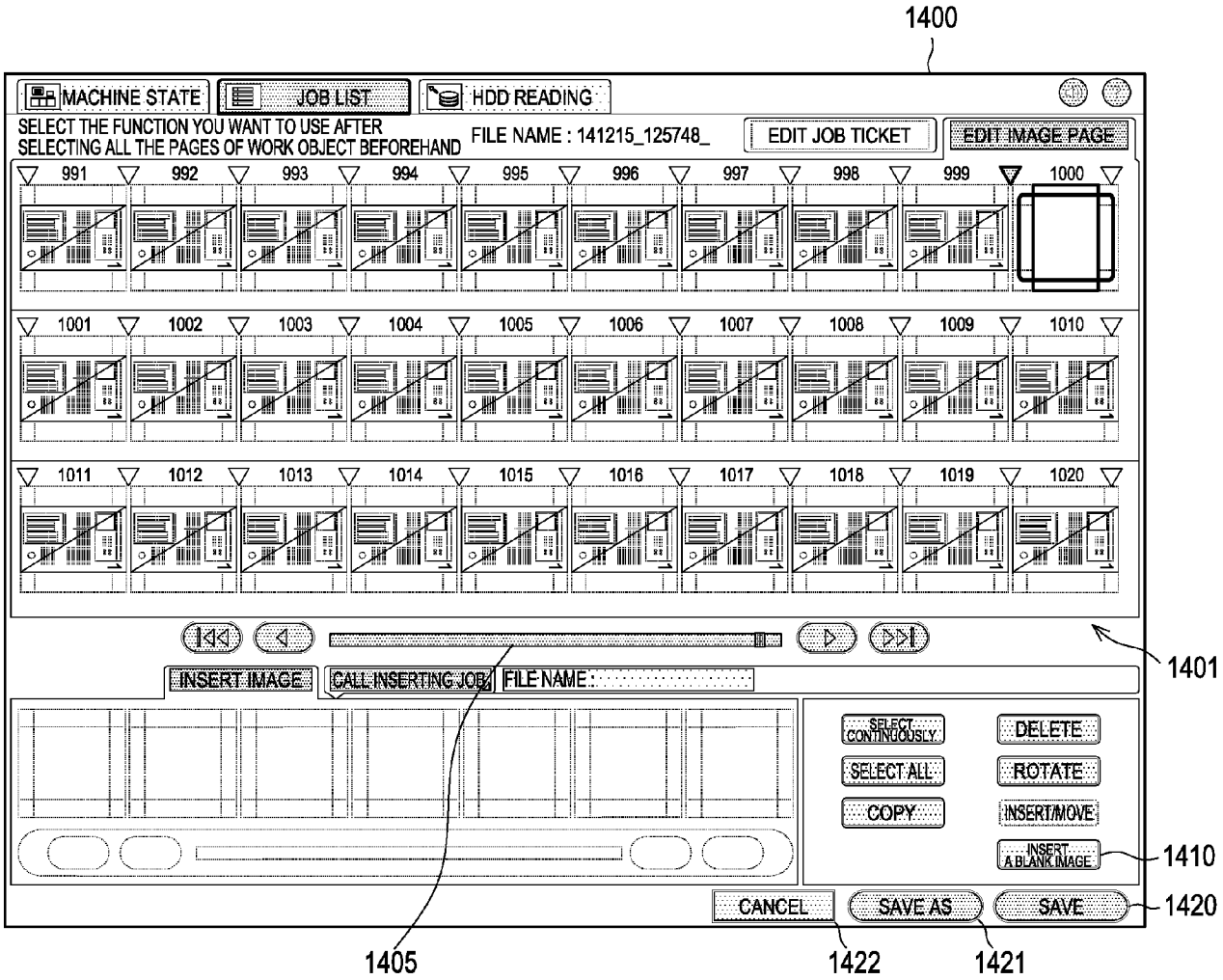
FIG. 4 illustrates a ticket image editing screen including operating buttons to insert a margin.

How to set the printing conditions with the operation displaying unit will now be explained with reference to the operating screen of FIG. 4.

The operating screen can be displayed on the operation displaying unit 140 as a ticket image editing screen 1400 and is used to perform necessary operations. On the ticket image editing screen 1400, images are displayed in the order of page, for example. A slide bar 1405 is operated to change the position of each page displayed. On the ticket image editing screen 1400, the operator can select, copy, delete, rotate, or insert a screen, insert a job, and insert a blank image, i.e., a margin between images. To insert a margin, an image is selected and the margin is inserted before or after the image. A margin can be inserted by touching a blank image inserting button 1410.

On this screen, a margin having the same sub-scanning length as each page or the integral multiple of the sub-scanning length of that of each page is inserted in the 1000th page.

After the operation, if the predetermined printing conditions are already registered, touching an overwrite save button 1420 saves the printing conditions. If the printing conditions are not registered, touching a new-file save button 1421 can newly save the printing conditions. Touching a cancel button 1422 cancels the conditions determined in the setting and returns the screen to the state before the setting.

The above-described situation will now be explained taking a specific example.

In the case of printing one copy of 1100 sheets of a document sized 210×297 mm (main scanning×sub-scanning), the length in the sub-scanning direction is 326700 mm (326.7 m) which exceeds the continuous printing distance (e.g., 300 m).

If no blank setting has been performed, adjustment is performed just after the upper limit of continuous printing distance (300 m) and therefore between the 1011th page and the 1012th page as shown in Table 1. This results in a space between images unintended by the user.

TABLE 1

| A conventional example | |
|---|---|
| Page number | Total printing distance (mm) |
| 1 | 297 |
| 2 | 594 |
| . | . |
| . | . |
| . | . |
| 1010 | 299970 |
| 1011 | 300267 |
| Adjustment | |
| 1012 | 300564 |
| . | . |
| . | . |
| . | . |
| 1100 | 326700 |

When the user sets a blank to be inserted in the 1000th page for the same job, the printing state is as shown in Table 2 because adjustment is performed in a blank for any job exceeding the continuous printing distance.

Adjustment performed in a blank part in the 1000th page prevents a space between images unintended by the user for the adjustment.

TABLE 2

| Page number | Total printing distance (mm) |
|---|---|
| 1 | 297 |
| 2 | 594 |
| . | . |
| . | . |
| . | . |
| 999 | 296703 |
| 1000 | Adjustment (Not print a blank part) |
| 1001 | 297000 |
| : | : |
| : | : |
| : | : |
| 1101 | 326700 |

An example screen on which the length of a blank necessary for adjustment is automatically set during the setting of the blank by the user will now be explained with reference to FIG. 5.

Figure 5:
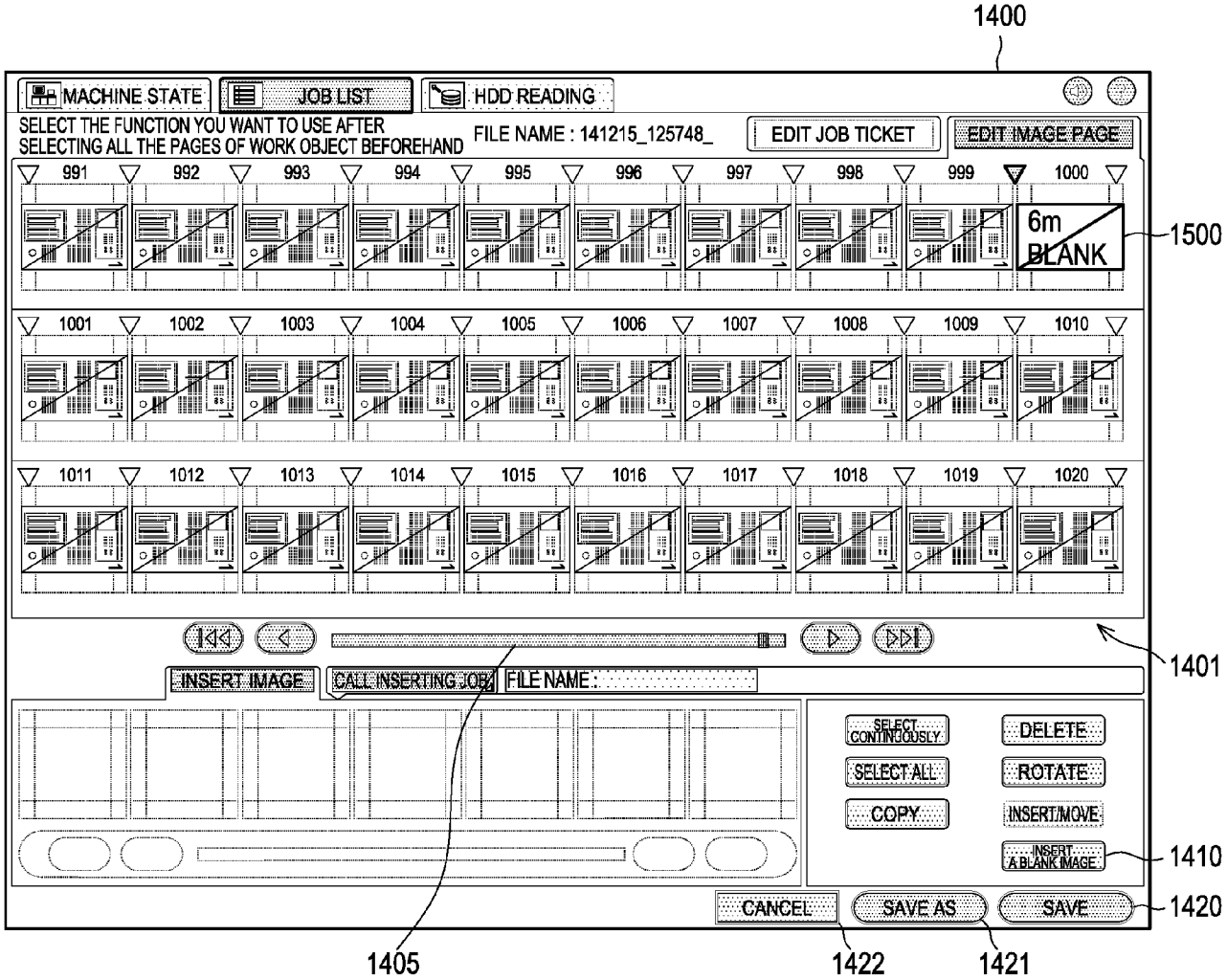
FIG. 5 illustrates a ticket image editing screen after insertion of a margin necessary for adjustment.

On the ticket image editing screen 1400 in FIG. 5, when the user touches the blank image inserting button 1410, a margin length necessary for the adjustment is determined in response to the judgment that the job exceeds the continuous printing distance, for example, and a margin 1500 having that margin length is automatically determined as well as the margin position set by the user. It should be noted that the margin length is at or above the margin length necessary for adjustment in a cycle along the sub-scanning direction of the image and can be automatically adjusted so as to match the cycle.

The margin length is automatically determined in the above explanation although the operator can alternatively determine a margin length and propose the margin length necessary for adjustment as a recommended value.

Figure 6:
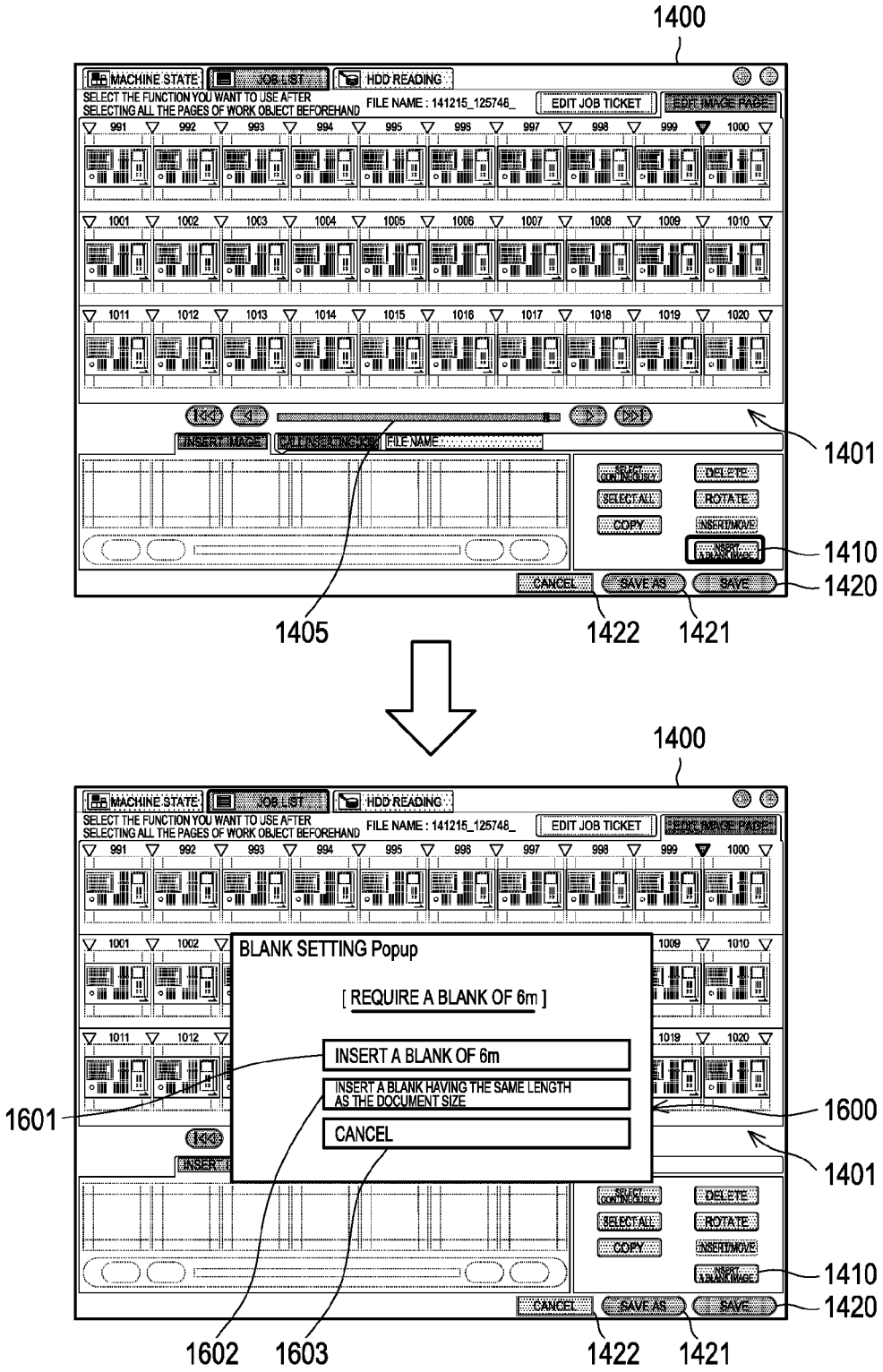
FIG. 6 illustrates an example ticket image editing screen on which a recommended value of margin length is determined.

As shown in the upper figure in FIG. 6, when the blank image inserting button 1410 is touched on the ticket image editing screen 1400, the length necessary for adjustment is determined. The necessary length can be read from the storage or calculated.

When the blank image inserting button 1410 is touched, the controlling unit can recommend a necessary length of the blank, on another screen or a pop-up window.

The lower figure in FIG. 6 shows the ticket image editing screen 1400 with a pop-up window 1600 on it. On the pop-up window 1600, a button 1601 to perform the setting of a margin with a length necessary for adjustment, a button 1602 to insert a blank having the same length as the document size, and a cancel button 1603 are operably displayed. Touching the button 1601 performs the setting of a blank with a length necessary for adjustment. At this time, a length at or above a blank length necessary for adjustment, for example, a length large enough for the cycle of images can be selected. Touching the button 1602 determines a margin length that has the same length as the document size. Touching the button 1603 cancels the blank length selected in the pop-up window 1600. The settings can be saved by touching the overwrite save button 1420 or the new-file save button 1421.

It should be noted that a fixed margin length is recommended during adjustment in the above explanation, although each margin length can be determined depending on the corresponding image data or location to insert the margin.

Table 3 shows a specific example where the length necessary for adjustment is determined depending on the coverage of a job. The references of a high coverage and low coverage are predetermined so that they can be distinguished from each other. Each coverage is determined to be high or low based on the references in order to determine the necessary margin length. The necessary margin length is stored in a nonvolatile memory or the like in accordance with the category of the coverage and may be read as needed or may be calculated by a predetermined formula.

Referring to an example in Table 3, adjustment with a high coverage requires a margin length of 2 m, whereas that with a low coverage requires a margin length of 6 m. It should be noted that the reason why a lower coverage requires a larger necessary margin length is because a lower coverage results in a higher rate of degradation of toners.

TABLE 3

| High coverage adjustment | | | Low coverage adjustment | | |
|---|---|---|---|---|---|
| Page number | Coverage | Total printing distance (mm) | Page number | Coverage | Total printing distance (mm) |
| 1 | High | 297 | 1 | Low | 297 |
| 2 | High | 594 | 2 | Low | 594 |
| . | High | . | . | Low | . |
| . | | . | . | | . |
| . | | . | . | | . |
| 999 | High | 296703 | 999 | Low | 296703 |
| 1000 | High | Adjustment (Require a blank of 2 m) | 1000 | Low | Adjustment (Require a blank of 6 m) |
| 1001 | High | 297000 | 1001 | Low | 297000 |
| . | High | . | . | Low | . |
| . | | . | . | | . |
| . | | . | . | | . |
| 1101 | High | 326700 | 1101 | Low | 326700 |

To insert a plurality of blanks in a job, the length necessary for adjustment can be divided to shorten a length necessary for each adjustment. As shown in Table 4, when a length of 6 m is needed for adjustment, a margin of 3 m is placed in two locations (the 500th page and the 1000th page) so that the length of blanks cannot be too large.

TABLE 4

| Blank divided | | |
|---|---|---|
| Page number | Coverage | Total printing distance (mm) |
| 1 | Low | 297 |
| 2 | Low | 594 |
| . | Low | . |
| . | | . |
| . | | . |
| 500 | | Adjustment (Require a blank of 3 m) |
| . | Low | . |
| . | | . |
| . | | . |
| 1000 | | Adjustment (Require a blank of 3 m) |
| . | Low | . |
| . | | . |
| . | | . |
| 1102 | Low | 326700 |

It should be noted that a warning can be displayed when a job exceeding the continuous printing distance is output. In this case, a warning should not be necessarily displayed if the selected blank length is judged to be large enough to perform adjustment.

Figure 7:
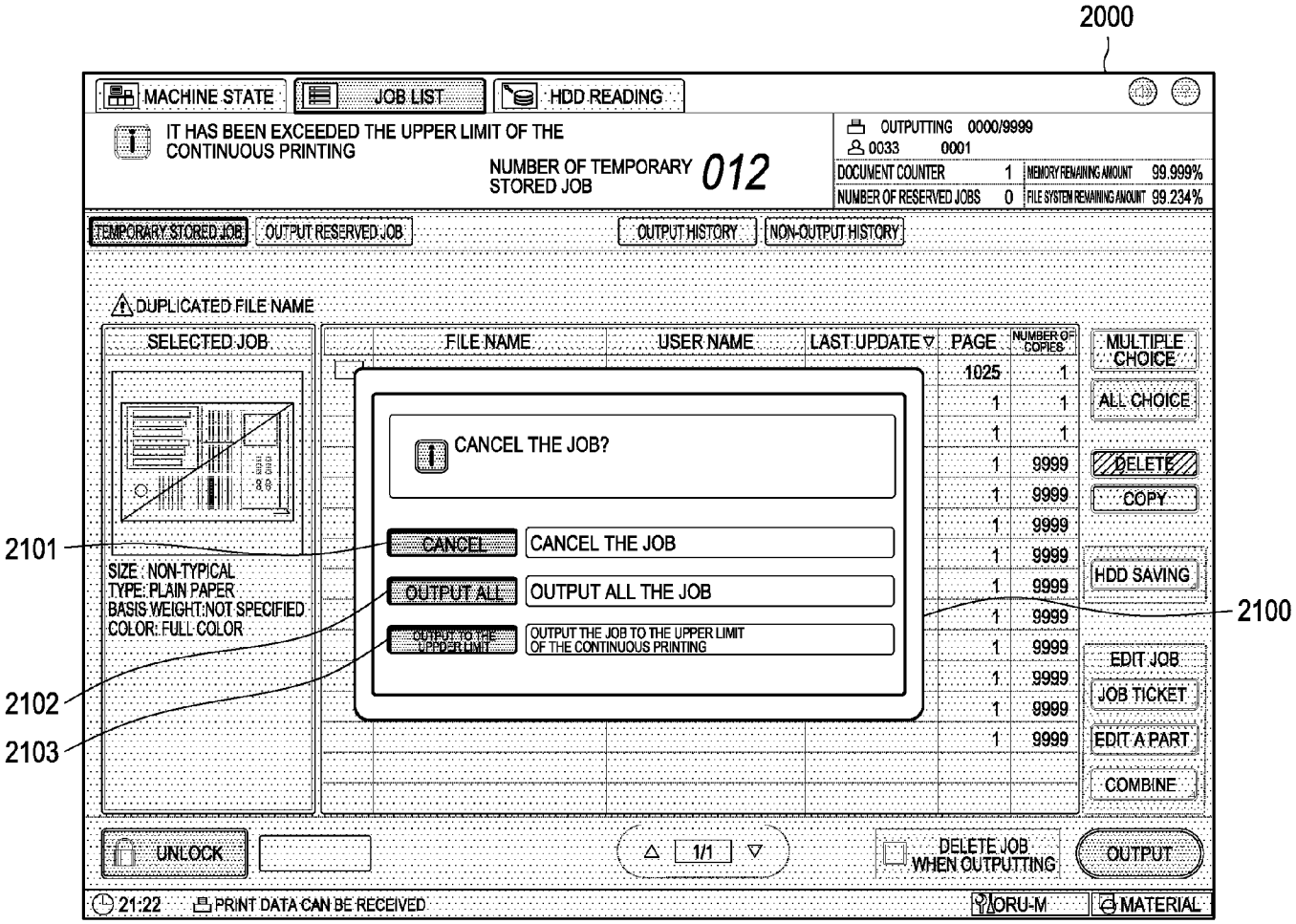
FIG. 7 illustrates an example screen showing a warning for a job exceeding a continuous printing distance.

FIG. 7 shows the case where a warning pop-up window 2100 is displayed on a job list tab 2000 displayed on the operation displaying unit 140, for a job exceeding the continuous printing distance. This case will be described below.

The warning pop-up window 2100 shows a "cancel" button 2101 to cancel the job, an "output all" button 2102 to output all the job, and an "output to the upper limit" button 2103 to output the job to the upper limit of the continuous printing distance. These buttons can all be operated by the operator.

The operator can cancel the output of the job by touching the "cancel" button 2101 if he thinks cancellation is appropriate. The operator can output all the job by touching the "output all" button 2102. At this time, if the length exceeds the reference continuous printing distance, adjustment between images is performed, which leaves a blank. Alternatively, at the time, the adjustment can be set not to be performed.

To continue output just until adjustment, the "output to the upper limit" button is touched. When the output is halted, the operator can notice that adjustment is just about to be performed.

For a job with an enough length of a blank, a printing operation can be started instead of displaying the warning pop-up window 2100. This eliminates unnecessary operations.

Figure 8:
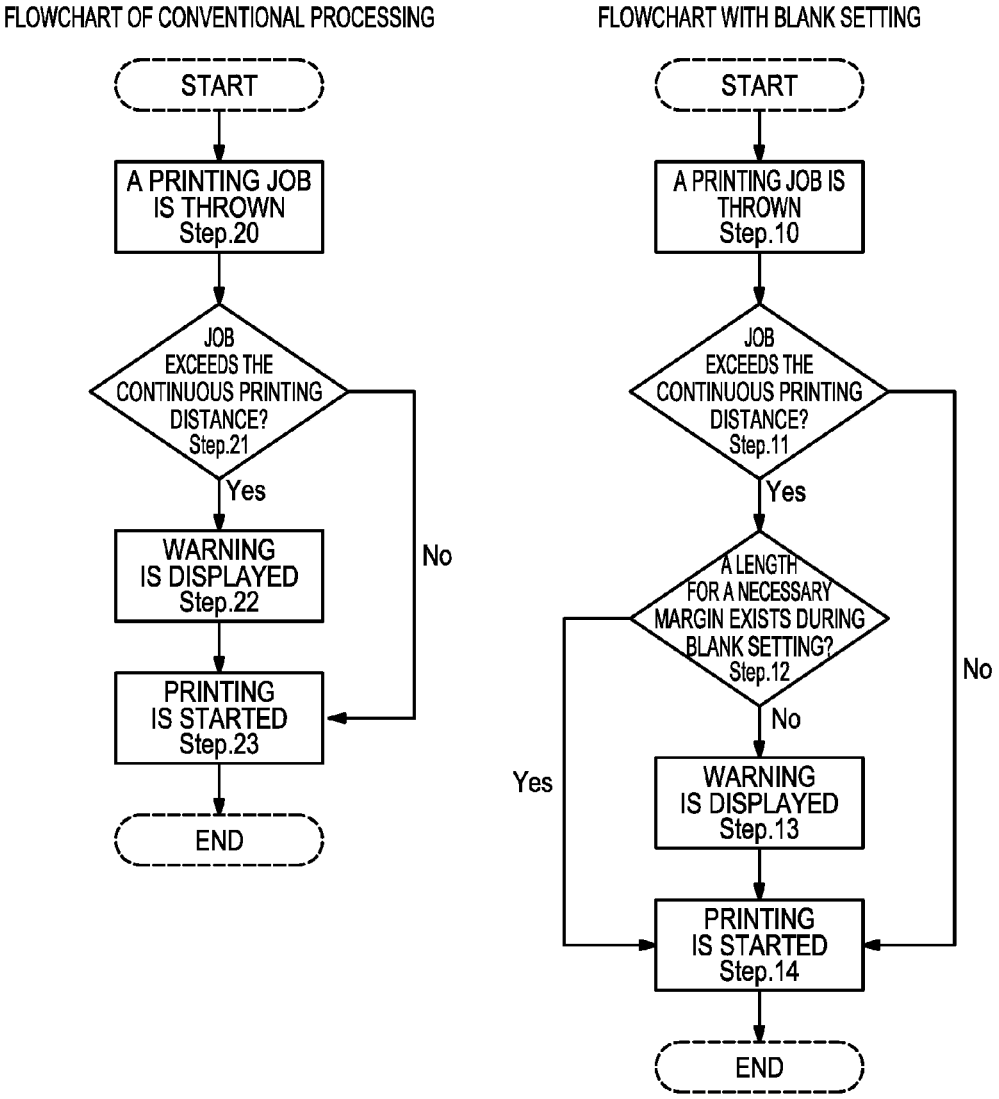
FIG. 8 shows flow charts of a conventional process for showing a warning for a job exceeding a continuous printing distance, and that according to the embodiment.

This process is shown in the flow chart of FIG. 8.

A conventional example will be first explained. A printing job is thrown (Step 20) and whether the job exceeds the continuous printing distance is determined (Step 21). If the job does not exceed the continuous printing distance (Step 21, No), printing is started (Step 23).

If the job exceeds the continuous printing distance (Step 21, Yes), a warning is displayed (Step 22) and printing is started (Step 23). After the printing is started, the process terminates.

In this embodiment, a printing job is thrown (Step 10) and whether the job exceeds the continuous printing distance is determined (Step 11). If the job does not exceed the continuous printing distance (Step 11, No), printing is started (Step 14).

If the job exceeds the continuous printing distance (Step 11, Yes), whether a length for a necessary margin exists is determined during blank setting (Step 12). If the length for the necessary margin exists (Step 12, Yes), printing is started (Step 14). If the length for the necessary margin does not exist (Step 12, No), a warning is displayed (Step 13) and printing is then started (Step 14). After the printing is started, the process terminates.

It should be noted that a plurality of jobs is combined in some cases (called "Build Job").

During Build Job, a blank is sometimes automatically inserted between combined jobs so that a break between the jobs can be easily recognized.

If the length of the combined jobs exceeds the continuous printing distance, it is preferable to automatically insert a blank at a break between the jobs and adjust the length of the blank part.

Figure 9:
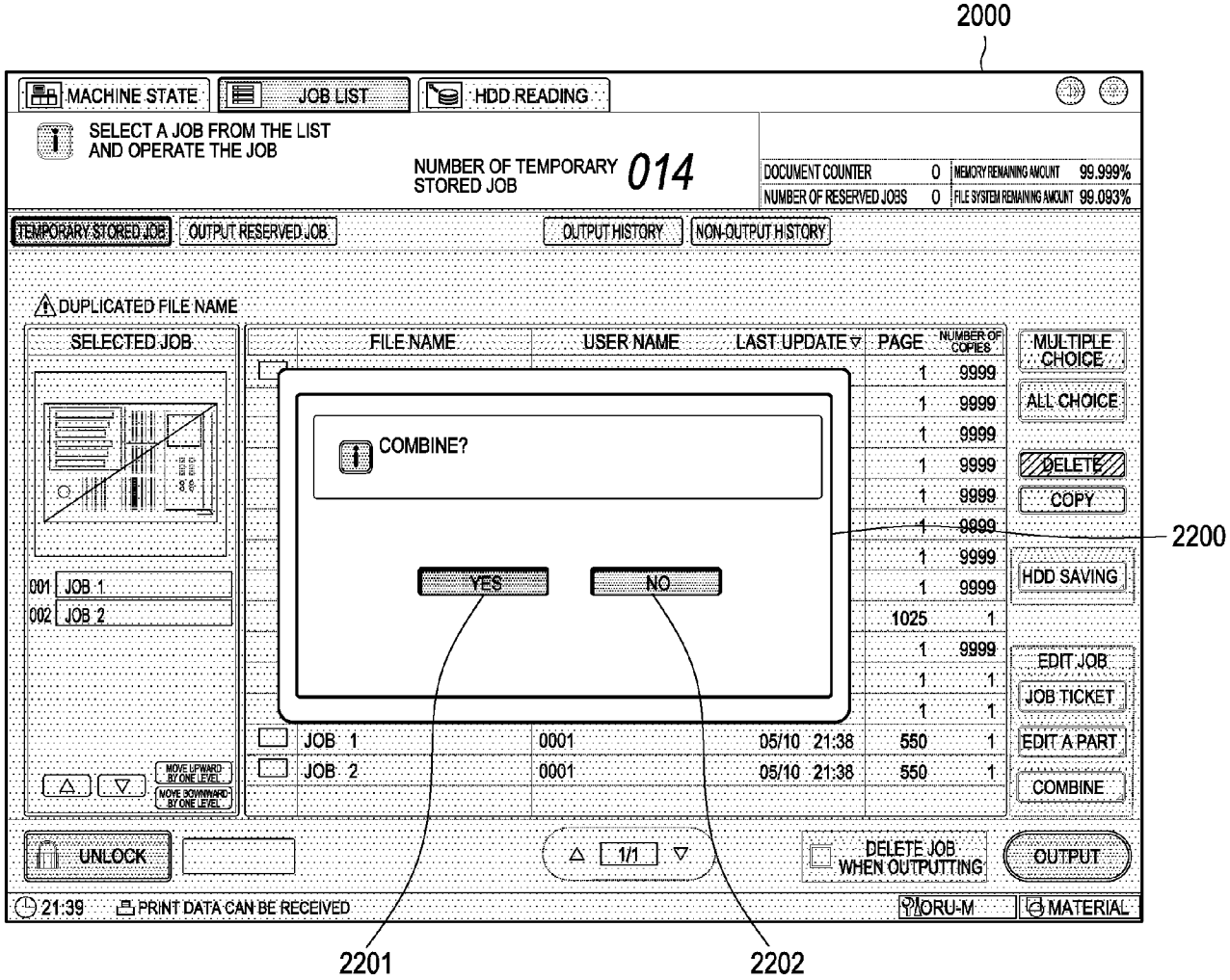
FIG. 9 illustrates an example screen that is operated to combine jobs.

FIG. 9 shows a combination pop-up window 2200 on the job list, which is used to combine jobs. The combination pop-up window 2200 shows a "Yes" button 2201 and a No button 2202 which can be operated by the operator. Touching the "Yes" button 2201 combines jobs and automatically sets a margin between the combined jobs. Touching the No button 2202 does not execute combination of jobs and does not set any margin in this step.

As shown in Table 5, an example combination of two jobs 1 and 2 has a continuous printing distance of 326.7 m which exceeds the upper printing distance.

JOB1: a 550-sheets document sized 210×297 mm (main scanning×sub-scanning)

JOB2: a 550-sheets document sized 210×297 mm (main scanning×sub-scanning)

In this case, a blank is inserted between JOB1 and JOB2. At this time the length of the blank can be automatically set to the length necessary for adjustment or a recommended value can be proposed.

TABLE 5

| Page number | Total printing distance (mm) | Job |
|---|---|---|
| 1 | 297 | JOB1 |
| . | . | |
| . | . | |
| . | . | |
| 550 | 163350 | |
| 551 | Adjustment (Not to print a blank part) | Blank |
| 552 | 163647 | JOB2 |
| . | . | |
| . | . | |
| . | . | |
| 1101 | 326700 | |

This embodiment, in which adjustment for continuous printing is performed in a predetermined blank, has an advantage of preventing an unnecessary space from being left in the printing areas other than the blank during adjustment.

Although the present invention has been described and illustrated in detail, it is clearly understood that the same is by way of illustrated and example only and is not to be taken by way limitation, the scope of the present invention being interpreted by terms of the appended claims.

What is claimed is:

1. An image forming device comprising:

an image forming unit that prints an image on a continuous transfer medium in accordance with a job; and a controlling unit that manages the job and controls printing in the image forming unit, the controlling unit having a function of setting a margin lying in a sub-scanning direction of the medium in the middle of printing the job in accordance with the printing conditions of the job, and a function of performing image formation adjustment within the margin, wherein the image formation adjustment uses a predetermined continuous printing distance as a reference, and, when the job exceeds the continuous printing distance, the controlling unit indicates a warning if a length of a blank is not set or if a set length of a blank is not enough, and does not indicate a warning if a blank with an enough length is set in a location before the continuous printing distance.

2. The image forming device according to claim 1, wherein the image formation adjustment is toner consumption adjustment.

3. The image forming device according to claim 1, further comprising an operation displaying unit that receives setting of printing conditions, wherein the setting of printing conditions includes setting of margin position.

4. The image forming device according to claim 3, wherein the controlling unit automatically sets the margin length to at least a length necessary for image formation adjustment, in accordance with the setting of margin position.

5. The image forming device according to claim 3, wherein the controlling unit recommends at least a margin length necessary for image formation adjustment in accordance with the setting of margin position.

6. The image forming device according to claim 4, wherein the controlling unit sets the margin length to an integral multiple of a distance between pages.

7. The image forming device according to claim 1, further comprising an operation displaying unit that receives setting of printing conditions, wherein the controlling unit enables setting of the margin position and the margin length through the operation displaying unit.

8. The image forming device according to claim 1, wherein the controlling unit determines a necessary length of the margin on the basis of image data to be printed and/or a location to insert the margin.

9. The image forming device according to claim 8, wherein the controlling unit determines a necessary length of the margin on the basis of coverage of the image data.

10. The image forming device according to claim 8, wherein the controlling unit determines, on the basis of the location in which the margin can be inserted, the margin length for the location.

11. The image forming device according to claim 1, wherein the controlling unit enables setting of a margin between jobs under a printing condition of continuous printing of combined jobs.

12. An image formation managing device that manages an image forming device printing an image on a continuous transfer medium in accordance with a job, the image formation managing device comprising:

a management controlling unit that manages the job and instructs the image forming device to perform printing, wherein the management controlling unit also instructs the image forming device to set a margin lying in a sub-scanning direction of the medium in the middle of printing the job in accordance with the printing conditions of the job and to perform image formation adjustment within the margin, wherein the image formation adjustment uses a predetermined continuous printing distance as a reference, and, when the job exceeds the continuous printing distance, the management controlling unit indicates a warning if a length of a blank is not set or if a set length of a blank is not enough, and does not indicate a warning if a blank with an enough length is set in a location before the continuous printing distance.

13. An image forming method for printing an image on a continuous transfer medium in accordance with a job, comprising the steps of:

receiving setting of printing conditions;

setting a margin lying in a sub-scanning direction of the medium in the middle of printing the job in accordance with the printing conditions of the job; and performing image formation adjustment within the margin, wherein the image formation adjustment uses a predetermined continuous printing distance as a reference, and, when the job exceeds the continuous printing distance, then: indicating a warning if a length of a blank is not set or if a set length of a blank is not enough, and not indicating a warning if a blank with an enough length is set in a location before the continuous printing distance.

14. The image forming method according to claim 13, wherein the image formation adjustment is toner consumption adjustment.

15. The image forming method according to claim 13, wherein the setting of printing conditions includes setting of margin position.

16. The image forming method according to claim 15, wherein the margin length is automatically set to at least a length necessary for image formation adjustment, in accordance with the setting of margin position.

17. The image forming method according to claim 13, wherein at least a margin length necessary for image formation adjustment is recommended in accordance with the setting of margin position.

18. The image forming method according to claim 16, wherein the margin length is set to an integral multiple of a distance between pages.

19. The image forming method according to claim 13, wherein a margin position and a margin length can be set through an operation displaying unit.

* * * * *